US005253502A

United States Patent [19]

Poletti

[11] Patent Number: 5,253,502

[45] Date of Patent: Oct. 19, 1993

[54] APPARATUS AND METHOD FOR BENDING AND FORMING SHEET MATERIAL

[75] Inventor: Joseph W. Poletti, Millstadt, Ill.

[73] Assignee: Alco Industries, Inc., Valley Forge, Pa.

[21] Appl. No.: 815,519

[22] Filed: Dec. 24, 1991

[51] Int. Cl.[5] ..... B21D 9/10

[52] U.S. Cl. ..... 72/213; 72/381; 72/383

[58] Field of Search ..... 72/381, 383, 389, 212, 72/213

[56] References Cited

U.S. PATENT DOCUMENTS

| | | | |
|---|---|---|---|
| 1,552,416 | 9/1925 | Bingham . | |
| 1,718,753 | 6/1929 | Miller . | |
| 2,286,255 | 6/1940 | Brooks . | |
| 2,669,891 | 2/1954 | Ware . | |
| 3,457,759 | 7/1969 | Doerr et al. . | |
| 3,613,427 | 10/1971 | Haddon . | |
| 3,705,512 | 12/1972 | Koschatzky . | |
| 4,002,049 | 1/1977 | Randolph, Sr. . | |
| 4,181,002 | 1/1980 | Eckhold et al. . | |
| 4,434,644 | 3/1984 | Gargrave et al. . | |
| 4,835,805 | 6/1989 | Gray | 72/213 |

FOREIGN PATENT DOCUMENTS

| | | | |
|---|---|---|---|
| 2050348 | 4/1972 | Fed. Rep. of Germany | 72/212 |
| 0032826 | 2/1982 | Japan | 72/381 |
| 0054422 | 3/1984 | Japan | 72/212 |
| 0044129 | 3/1985 | Japan | 72/213 |
| 0430919 | 6/1974 | U.S.S.R. | 72/389 |
| 0841705 | 7/1981 | U.S.S.R. | 72/381 |

OTHER PUBLICATIONS

Catalog "READY BENDERS" dated Jan. 1991, pp. 1-15, Ready Tools, Inc.

*Primary Examiner*—David Jones

*Attorney, Agent, or Firm*—Rogers, Howell & Haferkamp

[57] ABSTRACT

An apparatus for bending and forming sheet metal into U-shaped channel members is comprised of a support block for supporting a blank of sheet metal in a centered position, a pair of rollers that engage in rolling contact against opposite ends of the sheet metal, and an anvil around which the sheet metal blank is formed into the U-shaped channel member. The sheet metal blank is formed over opposite sides of the anvil by the rollers engaging in rolling contact against the opposite ends of the sheet metal blank. As the rollers roll over the opposite ends of the sheet metal blank, they bend and form the sheet metal ends into channel bends having acute interior angles. When the rollers are removed from the sheet metal ends, the resiliency of the sheet metal causes the channel bends to spring back from their acute angle configurations to right angle configurations. The rolling contact of the rollers over the opposite ends of the sheet metal produces the channel bends in the sheet metal without producing tooling marks in the surface of the sheet metal.

11 Claims, 3 Drawing Sheets

FIG. 4.
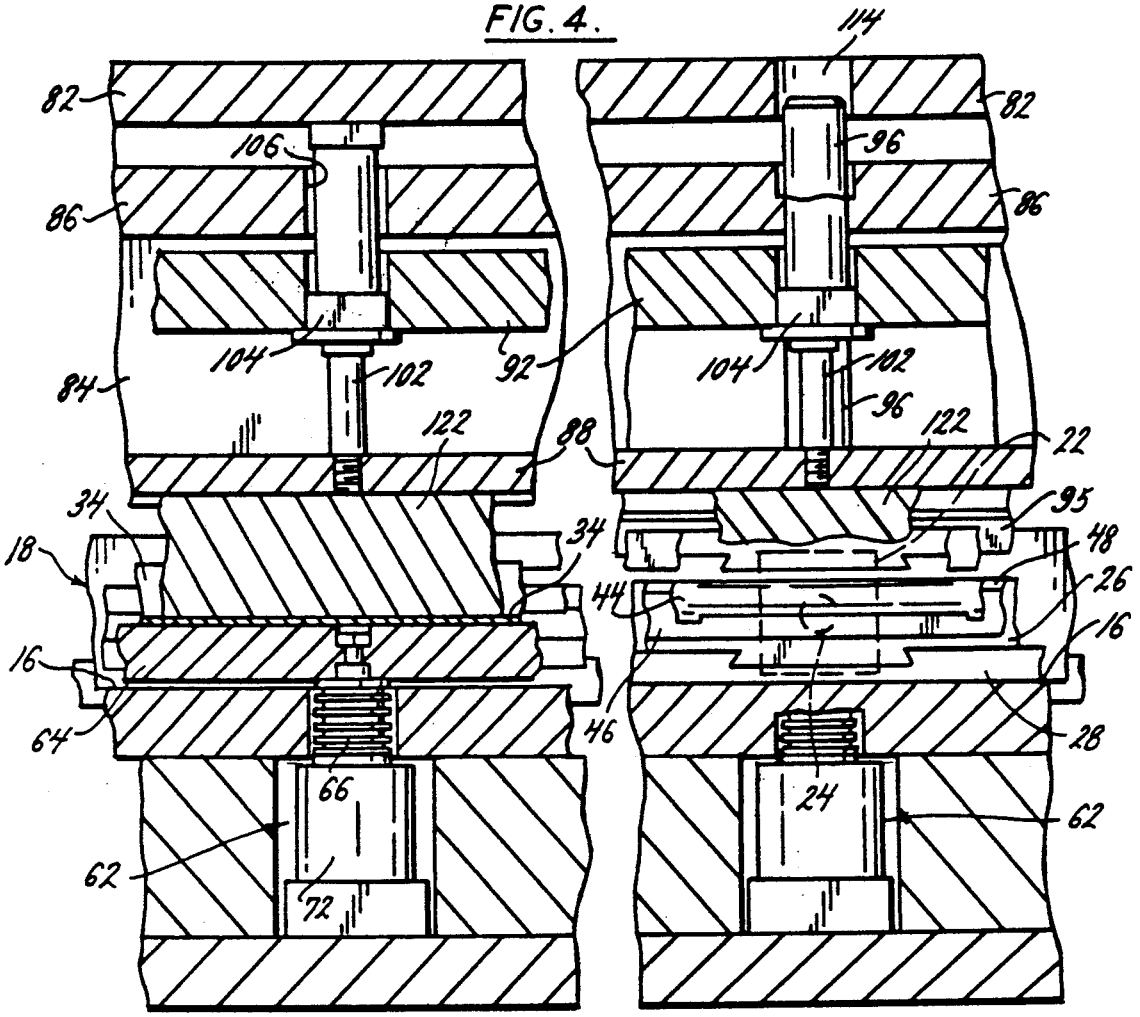
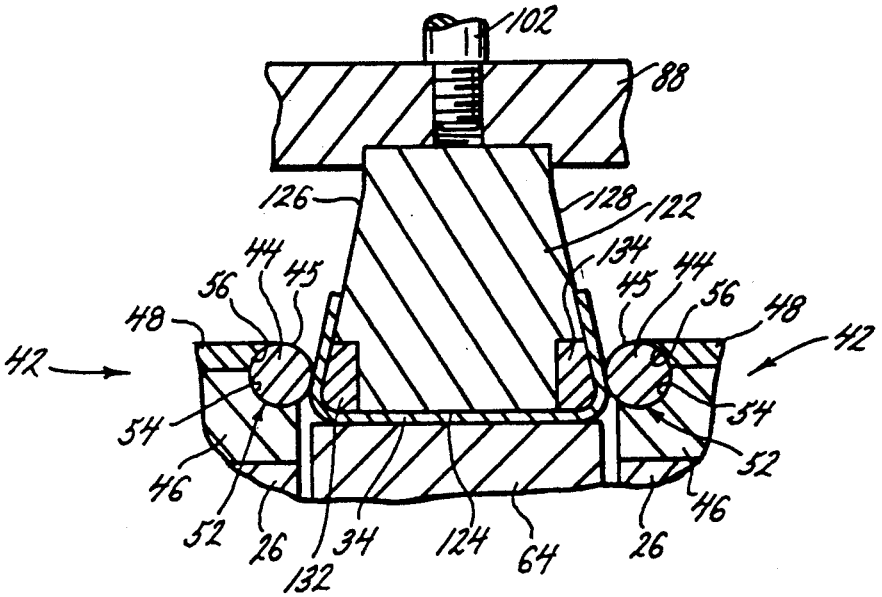
FIG. 5.

APPARATUS AND METHOD FOR BENDING AND FORMING SHEET MATERIAL

BACKGROUND OF THE INVENTION (1) Field of the Invention

The present invention relates to an apparatus and method for bending and forming sheet material such as sheet metal. In particular, the present invention relates to an apparatus and method of bending and forming opposite ends of sheet metal to form a U-shaped channel member, by employing rollers that roll over and form the channel bends without leaving tool marks in the sheet metal.

(2) Description of the Related Art

There are many different types of apparatus and various different methods that have been employed in forming channel bends in sheet metal to produce U-shaped channel members from the sheet metal. Examples of prior art apparatus and methods of forming sheet metal are disclosed in U.S. Pats. No. 4,002,049 and 4,434,644. In one example of a prior art sheet metal forming apparatus, bends in sheet metal are formed by an operating head having a cylindrical shape with a V-shaped notch extending longitudinally across the peripheral surface of the head. The V-shaped notch is defined by opposed side wall surfaces extending into the notch. The intersection of one of the wall surfaces and the peripheral edge of the head forms a fixing edge of the head, and the intersection of the other of the wall surfaces and the peripheral surface of the head forms a bending edge.

The cylindrical tool head is received in a semicircular groove formed in a tool holder of the prior art apparatus. The cylindrical tool head is positioned in the tool holder groove with the V-shaped notch formed in the tool head exposed. The tool head is secured in the holder groove for rotation of the tool head relative to the holder.

In operation of these prior art bending apparatus, the cylindrical tool head and holder are lowered toward an edge of a sheet metal blank supported on a die plate. The spaced edges of the tool notch engage a surface of the sheet metal adjacent to an end of the sheet metal to be formed in a channel bend. As the tool and holder are continued to be lowered they exert a force on the sheet metal end and bend the sheet metal end over the edge of the die plate positioned below the sheet metal. As the sheet metal end is bent over the die plate, one edge of the V-shaped notch engages a top surface of the sheet metal and holds the sheet metal down against the die plate while the other edge of the V-shaped notch bends the end of the sheet metal over the end of the die plate. As the other edge of the V-shaped notch bends the end of the sheet metal over the die plate, it slides in friction engagement over the end of the sheet metal. The sliding friction engagement of the tool notch edge over the sheet metal end often produces undesirable tooling marks in the sheet metal surface.

In various different types of prior art sheet metal forming apparatus similar to the prior art apparatus described above, the bends formed in sheet metal are produced by the sliding engagement of a tool over a surface of the sheet metal. In these other types of metal forming processes, as the bend in the sheet metal is formed by the tool the tool also produces undesirable tooling marks in the surface of the sheet metal due to the sliding engagement of the tool over the sheet metal. In many situations the presence of the tooling marks in the surfaces of the finished sheet metal products is unacceptable and additional finishing operations must be performed on the sheet metal products to remove the tooling marks. These additional finishing operations increase the expense involved in forming sheet metal products.

In prior art methods of forming U-shaped channel members from sheet metal stock, the channel members are often formed by first producing one channel bend along one side of the sheet metal, and then forming the second channel bend along the opposite side of the sheet metal. This prior art method of forming channel members often results in one of the channel bends having dimensions different from the other channel bend, or one of the channel bends having an angular orientation that is different from the other channel bend.

What is needed to overcome the above described disadvantages of prior art sheet metal forming apparatus and methods is an apparatus and method for forming bends in sheet metal without marring or producing tooling marks in the surfaces of the sheet metal. What is also needed to overcome the above described disadvantages in forming channel bends in U-shaped channel members is an apparatus and method of forming the channel bends that produces equal angular orientations in each of the channel bends and equal dimensions of each of the channel bends formed.

SUMMARY OF THE INVENTION

The present invention overcomes the disadvantages associated with many prior art sheet metal forming apparatus and methods by providing an apparatus and method that are capable of forming bends in sheet metal without marring the surface of the sheet metal or producing tooling marks in the sheet metal. Moreover, the apparatus and method of the present invention overcome the disadvantages associated with prior art apparatus and methods for forming channel bends of U-shaped channel members by providing an apparatus and method of simultaneously forming channel bends in opposite sides of a sheet metal blank, where the channel bends are formed with substantially identical angular orientations and substantially identical dimensions.

The apparatus of the present invention is basically comprised of a pair of roller assemblies, a support block assembly for supporting a blank of sheet metal thereon, and an anvil assembly around which the sheet metal blank is formed to produce a channel member from the sheet metal. Each of the component parts of the present invention are assembled on a conventional sheet metal forming press and are employed with the press in performing the method of forming channel bends in sheet metal of the present invention.

In forming channel bends in sheet metal to produce a U-shaped channel member, a blank of sheet metal is first supported on the support block assembly of the present invention in a centered position on the support block assembly. The anvil of the present invention is then lowered down onto the sheet metal and secures the sheet metal in a stationary position between the anvil and the support block assembly. The anvil, the support block assembly, and the sheet metal secured therebetween are then moved relative to the pair of roller assemblies of the present invention, causing rollers of the pair of roller assemblies to come into contact with opposite ends of the sheet metal. The anvil continues to move the sheet metal relative to the rollers of the roller assembly as the rollers roll over the opposite ends of the sheet metal, bending and forming the opposite ends over the opposite sides of the anvil. As the anvil continues to move relative to the roller assembly rollers, the rollers continue to roll over the opposite ends of the sheet metal forming the sheet metal ends against the opposite sides of the anvil and producing channel bends with acute interior angles in the opposite ends of the sheet metal.

Following formation of the channel bends, the anvil is then moved in an opposite direction away from the pair of roller assemblies. As the anvil is separated from the pair of roller assemblies, the channel bends formed in the opposite ends of the sheet metal resiliently spring back from the acute angles formed in the channel bends to right angle configurations. The channel member formed from the sheet metal with the right angle channel bends formed therein is then removed from the forming press.

By the bending and forming method described above, the apparatus of the invention simultaneously forms channel bends in opposite ends of a sheet metal blank without marring or producing tooling marks in the surfaces of the sheet metal as the bends are formed. By forming the channel bends simultaneously, they are assured of being formed with substantially equal angles in the channel bends and substantially equal dimensions of the channel bends.

BRIEF DESCRIPTION OF THE DRAWINGS

Further objects and features of the present invention are revealed in the following detailed description of the preferred embodiment of the invention and in the drawing figures wherein:

FIG. 4 is a fractional side elevation view, partially in section, of the apparatus of the invention taken along the line 4—4 of FIG. 3; and, FIG. 5 is a fractional front elevation view of the apparatus of the invention bending and forming sheet material into a U-shaped channel member according to the method of the invention.

DESCRIPTION OF THE PREFERRED EMBODIMENT

Figure 1:
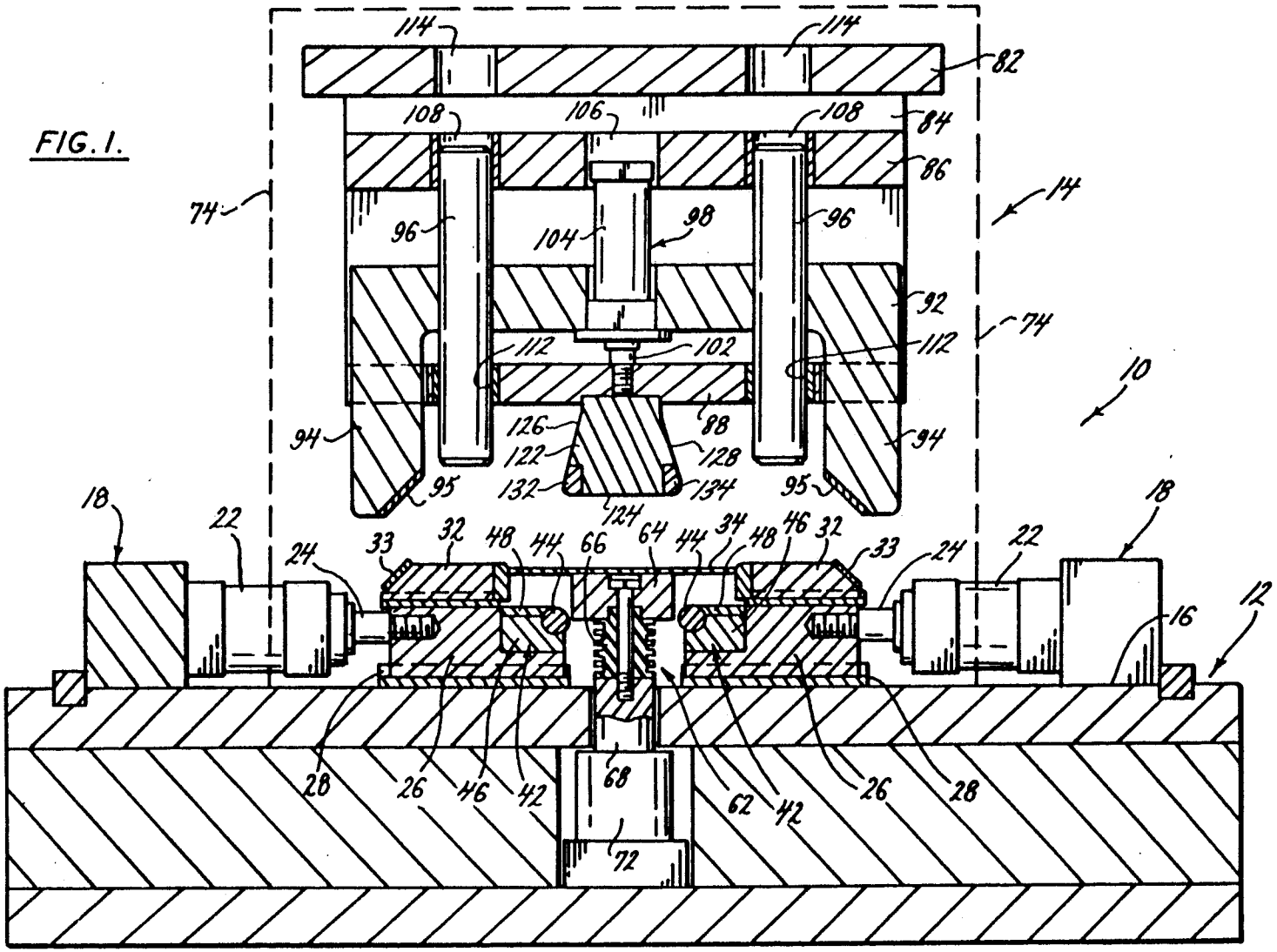
FIG. 1 is a front elevation view of the apparatus of the invention employed in one operative environment of the invention.

The apparatus and method of the present invention are illustrated and described as being employed in a conventional sheet metal forming press 10 to form channel bends in opposite ends of sheet material inserted in the press without marring or producing tool marks in the sheet material. The description of the apparatus and method of the invention is intended to be illustrative only and should not be interpreted as limiting. The apparatus and method of the invention may be employed in various different types of sheet metal forming apparatus other than that shown and described herein.

The sheet metal forming press assembly 10 with which the apparatus of the invention is employed is generally comprised of a horizontal base 12 and a ram assembly 14 that moves vertically relative to the base. The base and ram assembly are component parts of a conventional sheet metal forming press and the details of these component parts are not described in detail. Likewise, the manner in which the ram assembly 14 is connected with the base 12 to enable vertical movement of the ram assembly relative to the base is well known in the prior art and therefore is not shown in the drawing figures or described herein in order to simplify the description of the apparatus of the invention.

The base of the press 12 includes a horizontal work surface 16 with a pair of linear actuators 18 mounted at opposite left and right ends of the work surface 16 as viewed in FIG. 1. The linear actuator assemblies 18 are substantially identical to each other and like reference numbers are employed to identify like component parts of each actuator. The actuator assemblies 18 include cylinder housings 22 containing reciprocating pistons (not shown) in the interiors of the housings. Piston rods 24 are connected to the pistons for reciprocating movement with the pistons. The piston rods extend from the mutually opposed ends of the two actuator cylinders 22. The distal ends of the piston rods 24 are secured to a pair of sleds 26.

The pair of sleds 26 are mounted on the working surface 16 of the base for reciprocating sliding movement over the base. Rails 28 secured to the working surface 16 of the base 12 engage in grooves (not shown) provided in the underside of each sled 26 and guide the sleds along linear, reciprocating movements over the working surface 16 of the base.

Fluid conducting conduits (not shown) communicate with the interiors of the cylinders 22 on opposite sides of the pistons (not shown) contained inside the cylinders. Selective supply of pressurized fluid through the conduits to first sides of the pistons results in the piston rods 24 being retracted into the cylinders. Retraction of the piston rods 24 into the cylinders 22 pulls the sleds 26 over the rails 28 and the base work surface 16 to positions where the sleds are spaced apart from each other to their furthest extent. Selective supply of pressurized fluid through the conduits to the second or opposite sides of the pistons results in the piston rods 24 being extended from the cylinder interiors to their maximum extent. The extension of the piston rods 24 from the cylinders 22 forces the sleds 26 to slide over the rails 28 and the base work surface 16 toward each other. The full extension of the piston rods 24 from the cylinders 22 and the closest positioning of the sleds 26 toward each other is shown in FIG. 1 of the drawing figures. In this position, the sleds 26 engage against abutments (not shown) on the base work surface 16 that prevent the sleds 26 from moving closer to each other.

A pair of centering blocks 32 are mounted on the top surfaces of the two sleds 26. Cam surfaces 33 are provided on the outer most ends of the two centering blocks. The centering blocks 32 are also provided with grooves (not shown) in their undersides that engage over rails 34 provided on the top surfaces of the sleds 26. The rails and grooves direct the centering blocks 32 along linear reciprocating movements toward and away from each other. The pair of centering blocks 32 are employed in positioning sheet metal 34 inserted into the press 10 in a centered position relative to the press prior to bending and forming operations performed on the sheet metal by the press.

The component parts of the base 12 of the sheet material forming press 10 described up to this point are conventional and are found in various different forms and in many different types of sheet metal forming presses. The above described component parts of the press base 12 do not form a part of the present invention and therefore have not been described in detail.

The apparatus of the present invention includes a pair of roller assemblies 42 and a sheet material support assembly 62. The roller assemblies and the support assembly are assembled on the base 12 of the press assembly 10 described above. The roller assemblies 42 are substantially identical, and like reference numbers are used to identify like component parts of each roller assembly. Each roller assembly is basically comprised of a roller 44, a saddle block 46 and a gib 48. The details of the roller assemblies 42 are best seen in FIG. 5.

Each of the saddle blocks 46 has a general rectangular configuration and is secured on one of the mutually opposed faces of the pair of sleds 26 as seen in the drawing figures. The saddle blocks 46 may be secured to the sleds 26 in any known manner. Arcuate grooves 52 are formed in the upper, proximate corners of the two saddle blocks 46. The grooves 52 are substantially identical and extend completely across the transverse width of the blocks, or into the drawing figures as viewed in FIGS. 1 and 5. Each of the grooves 52 are formed as semi-circular shaped bearing surfaces 54. The curvature of the bearing surfaces 54 is determined to complement the curvature of the exterior surfaces of the rollers 44. In cross section, the curvature of each groove 52 delineates an arc of a circle having a predetermined diameter.

The pair of rollers 44 are substantially identical to each other and have a cylindrical configuration with a constant diameter along their entire lengths. The lengths of each of the rollers 44 is substantially equal to the transverse widths of the saddle blocks 46. The diameter of the rollers 44 is slightly less than the diameter of the saddle block grooves 52 and provides the cylindrical exterior surface of the rollers 44 with a curvature that is cradled on the bearing surfaces 54 of the saddle block grooves 52. By forming the exterior surfaces of the rollers 44 with a circular curvature that nests on the bearing surfaces 54 of the saddle block grooves 52, the grooves 52 support the pair of rollers 44 in sliding engagement. The sliding engagement of the rollers 44 in the saddle block grooves 52 enables the rollers to rotate relative to the apparatus about their center axes, and also enables the center axes of the rollers to move linearly relative to the apparatus with linear movement of their supporting saddle blocks 46 and sleds 26.

Each of the gib plates 48 are secured to top surfaces of the saddle blocks 46 in any known manner. As seen in the drawing figures, the mutually opposed edges of the gib plates 48 are provided with curved surfaces 56 having a curvature substantially identical to the curvature of the saddle block bearing surfaces 54. With the pair of rollers 44 supported in the grooves 52 of the saddle blocks 46 and the pair of gib plates 48 secured to the top surfaces of the saddle blocks, the curved surfaces 56 of the gib plates form extensions of the bearing surfaces 54 of the saddle blocks. The extended bearing surfaces 54, 56 extend around more than 180° of the circumference of the rollers 44, providing a bearing surface engagement over more than half of the exterior surfaces 45 of the rollers 44. In this manner, the pair of rollers 44 are secured in the grooves 52 of the saddle blocks 46 and are free to rotate about their center axes in the saddle block grooves.

The apparatus of the invention also includes a vertically biased support block assembly 62 on the base 12 of the press. The support block assembly is generally comprised of a support block 64, a pedestal 66, a piston rod 68 and a cylinder housing 72. As seen in the drawing figures, the support block 64 is secured on top of the pedestal 66 which, in turn, is secured to a top most end of the piston rod 68. The pedestal 66 is provided with a plurality of fins extending around its circumference to dissipate heat transferred to the pedestal 66 from hot sheet metal 34 placed on the support block 64. The piston rod 68 extends into the interior of the cylinder housing 72 and is connected to a piston head (not shown) inside the cylinder housing. The piston head inside the cylinder housing 72 is subjected to a constant fluid pressure that forces the piston to extend the piston rod 68 from the housing 72 to its maximum extent shown in FIG. 1. With the piston rod 68 fully extended from the cylinder housing 72, the pedestal 66 and support block 64 position the sheet metal 34 above the pair of rollers 44 and between the pair of centering blocks 32 as seen in FIG. 1. The fluid pressure force on the piston head is sufficient to extend the piston rod 68 and elevate the sheet metal 34 supported on the support block 64 to its position shown in FIG. 1, but is not so large as to prevent the piston rod 68 from being forced down into the interior of the cylinder housing 72 in a manner to be described.

The press ram assembly 14 is a modification of known ram assemblies employed in sheet metal forming presses. The ram assembly 14 is shown in FIG. 1 suspended in its at rest position above the press base 12. The ram assembly 14 is secured to elements of a conventional press (not shown) that selectively move the ram assembly 14 vertically toward and away from the press base 12. Because the portion of the press 10 that suspends the ram assembly 14 above the base 12 and selectively moves the ram assembly 14 vertically toward and away from the base 12 is conventional, it is not shown in detail in the drawing figures or further described herein, but is represented by dashed lines 74 in FIG. 1. The ram assembly 14 is comprised of a base plate 82 that is secured to the conventional sheet metal forming press 74 in any known manner. Secured to the underside of the base plate 82 is a vertically depending support wall 84. Secured to the support wall 84 is a top guide plate 86 and a bottom guide plate 88. Together, the base plate 82, the support wall 84, and the top and bottom guide plates 86, 88 form a rigid frame that is selectively raised and lowered by the press assembly 74 to which the apparatus of the invention is assembled.

A centering frame 92 is supported on the ram assembly 14 for vertical movement relative to the ram assembly. The centering frame 92 is formed with a pair of downward depending legs 94 and a pair of vertical guide rods 96 secured to the frame 92. Centering cam surfaces 95 are provided on mutually opposed corners of the bottom ends of the legs 94.

A piston and cylinder assembly 98 supported on the bottom guide plate 88 of the ram assembly 14 is connected with the centering frame 92. The piston and cylinder assembly is comprised of a piston rod 102 secured to the bottom guide plate 88 and extending into the interior (not shown) of a cylinder housing 104. The piston rod 102 is secured to a piston head (not shown) inside the cylinder housing 104. A fluid conducting conduit (not shown) communicates with the interior of the cylinder 104 above the piston and selectively supplies pressurized fluid to the cylinder interior.

By selectively supplying pressurized fluid to the cylinder housing interior above the piston head and exhausting the fluid from the cylinder, the piston rod 102 is extended from the cylinder interior or retracted into the cylinder interior. In the relative positions of the cylinder housing 104 and the piston rod 102 shown in FIG. 1, the piston rod is retracted into the cylinder housing to its maximum extent. Retracting the piston rod 102 into the cylinder housing 104 as shown in FIG. 1 positions the centering frame 92 in its lowest position relative to the ram assembly 14. By extending the piston rod 102 from the cylinder housing 104, the centering frame 92 is elevated relative to the ram assembly 14.

A clearance hole 106 is provided in the top guide plate 86 to allow for the upward vertical movement of the cylinder housing 104 through the clearance hole when the piston rod 102 is extended from the cylinder housing interior. Pairs of guide holes 108, 112 are provided through the top guide plate 86 and bottom guide plate 88, respectively. The guide holes receive the pair of guide rods 96 as they move upward relative to the ram assembly in response to the piston rod 102 being extended from the cylinder housing 104, and as they move downward relative to the ram assembly 14 in response to the piston rod 102 being retracted back into the cylinder housing 104. A pair of clearance holes 114 are provided in the base plate 82 to receive the uppermost ends of the pair of guide rods 96 when they are elevated relative to the ram assembly.

The component parts of the press ram assembly 14 described to this point are all conventional and therefore have not been described in detail. Many prior art sheet metal forming presses comprise ram assemblies constructed similar to the ram assembly 14 described above and shown in the drawing figures, and these prior art ram assemblies function in substantially the same manner by selectively raising and lowering the ram assembly relative to the press base 12.

The apparatus of the invention includes an anvil 122 added to the ram assembly 14 in the position shown in the drawing figures. As seen in the drawing figures, the anvil 122 is secured to an underside of the bottom guide plate 88 of the ram assembly. The anvil is formed with a substantially horizontal bottom surface 124 and a pair of side surfaces 126, 128 on opposite left and right sides of the anvil as viewed in FIG. 1. Left and right lobe inserts 132, 134 are secured to the opposite left and right sides of the anvil, respectively, where the anvil bottom surface 124 intersects the left and right side surfaces 126, 128. The lobes 132, 134 present corners that are radiused for the specific curvature desired to be formed in the inside of channel bends to be formed in the sheet metal 34 by the press 10. As is best seen in drawing FIG. 5, the opposite left and right surfaces 126, 128 of the anvil are oriented at acute interior angles relative to the bottom surface 124. The specific angles formed between the opposite left and right side surfaces 126, 128 and the bottom surface 124 of the anvil are determined to form 90° channel bends in the opposite ends of the sheet metal 34 formed into a channel member by the press. The acute interior angles between the opposite left and right surfaces 126, 128 and the bottom surface 124 of the anvil are substantially equal to each other and are chosen dependent on the thickness of the sheet metal 34 being formed into the channel member in order to compensate for spring back of the sheet metal ends after the channel bends have been formed by the apparatus. To form different angled bends in the sheet metal the angular orientation of the side surfaces and the bottom surface would be altered accordingly.

It should be understood that the roller assemblies 122, the support block assembly 62, and the anvil 42 each have length dimensions sufficiently large to form a desired length of channel member from a blank of sheet material of the desired length. The lengths of the component parts of the apparatus of the invention extend into the press as shown in FIG. 1. FIG. 4 shows a side view of the press 10 with which the apparatus of the invention is employed. It should be understood that along the lengths of the roller assemblies, the support block, and the anvil, additional linear actuators 18, support block assemblies 62 and piston/cylinder assemblies 98 are provided to operate the component parts of the apparatus of the invention according to the method of the invention to be described.

In the embodiment of the invention shown in the drawing figures, the roller assemblies 42, the support block assembly 62, and the anvil 122 of the invention are employed in the sheet metal forming press 10 to form sheet metal 34 into a U-shaped channel member with right angle channel bends running along its opposite sides. The operation of the apparatus of the invention to be described is illustrative of only one bending and forming operation capable of being performed by the apparatus of the invention and is not intended to be limiting. The apparatus of the invention may be employed in conventional sheet metal forming presses to bend and form sheet metal into a variety of configurations other than the U-shaped channel member described.

Figure 2:
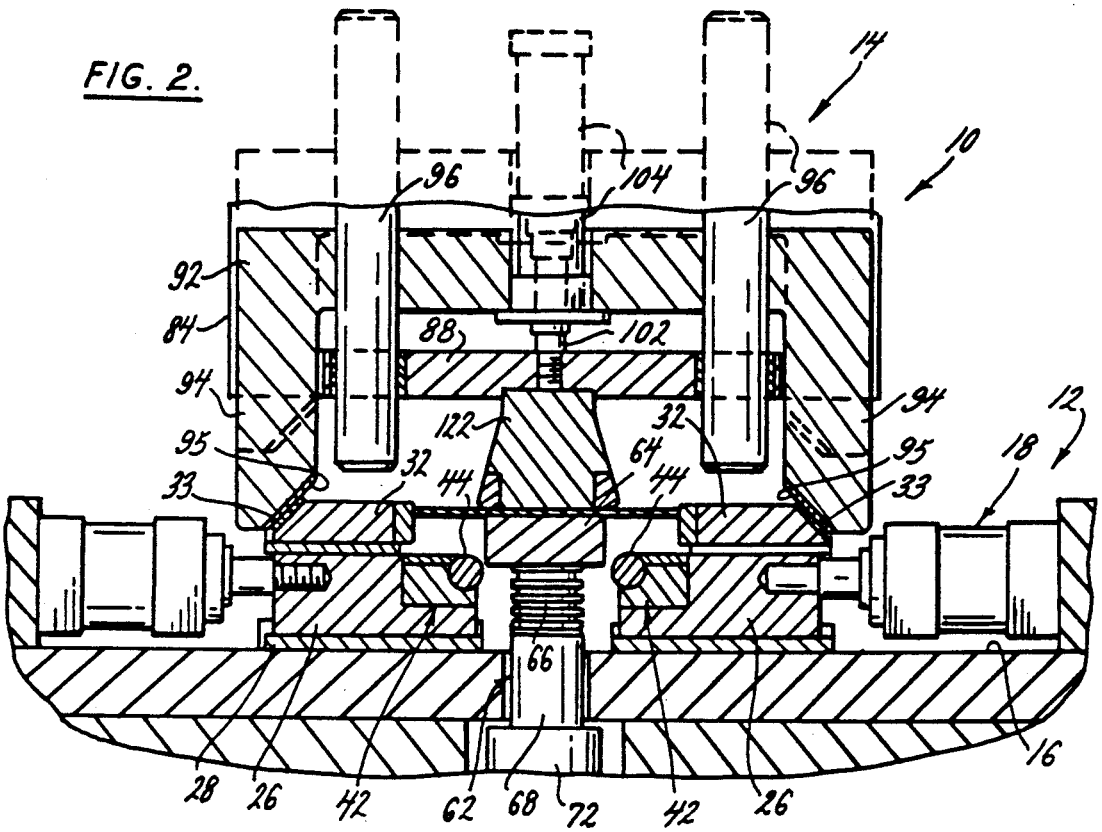
FIG. 2 is a front elevation view of the apparatus of the invention bending and forming sheet material into a U-shaped channel member according to the method of the invention.

FIG. 1 shows the relative positions of the roller assemblies 42, the support block assembly 62, and the anvil 122 that make up the apparatus of the invention, and the relative positions of the component parts of the conventional sheet metal forming press 10 in which the apparatus of the invention is employed, prior to execution of the sheet metal forming method of the present invention. In the initial steps of the method of the invention, a hot blank of sheet metal 34 is positioned on the top surface of the support block 64 with the centering blocks 32 engaged against opposite left and right edges of the sheet metal 34. With the sheet metal positioned on the support block 64, the entire press ram assembly 14 is lowered by the press until the bottom surface 124 of the anvil 122 engages the top surface of the sheet metal 34 and the centering cam surfaces 95 of the centering frame legs 94 engage the cam surfaces 33 of the centering blocks 32. This initial step of the sheet metal forming process is shown in FIG. 2. The engagement of the centering frame cam surfaces 95 with the centering block cam surfaces 33 slides the centering blocks 34 over the tops of the sleds 26. The sliding movement of the centering blocks 32 over the sleds 26 causes the blocks to exert a centering force on opposite left and right edges of the sheet metal and center the sheet metal 34 on the support block 64.

With the sheet metal 34 centered on the support block 64, the piston cylinder assembly 98 of the ram assembly 14 is actuated causing the piston rod 102 to extend from the cylinder housing 104 and causing the centering frame 92 to elevate relative to the ram assembly 14. With the piston rod 102 fully extended from the cylinder housing 104, the centering frame is elevated relative to the ram assembly 14 to the position of the centering frame shown in phantom lines in FIG. 2. In this position of the centering frame the frame legs 94 are disengaged from the centering blocks 32 and the centering blocks 32 are free to move apart from each other over the top surfaces of the sleds 26 and no longer exert a force on the opposite left and right edges of the sheet metal 34.

With the centering frame 92 elevated relative to the ram assembly 14 and anvil 122, the ram assembly is again moved downward toward the press base 12. Downward movement of the ram assembly moves the anvil 122 downward. The downward movement of the anvil 122 is opposed by the support block assembly 62. The anvil 122 exerts a downward force on the support block 64, the pedestal 66 and the piston rod 68, forcing the piston rod 68 and the piston head (not shown) attached thereto downward through the interior of the cylinder housing 72. The downward movement of the piston head through the cylinder housing 72 is opposed by the force of fluid pressure inside the cylinder housing acting against the piston head. The fluid pressure in the cylinder housing is controlled to exert a reactive force in opposition to the downward movement of the anvil 122, where the reactive force is sufficient to keep the sheet metal 34 gripped secure between the support block 64 and the bottom surface of the anvil, yet is not so great as to prevent the continued downward movement of the anvil 122 toward the press base 12.

Figure 3:
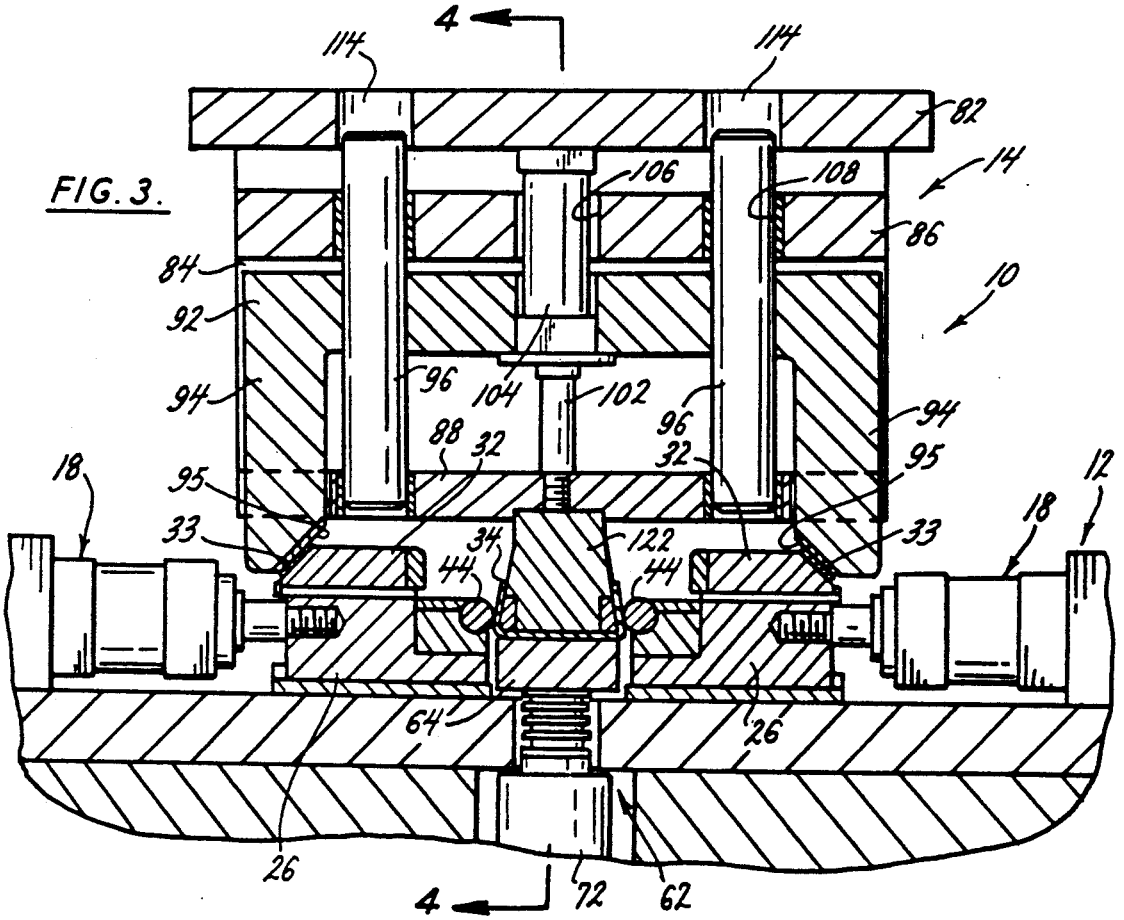
FIG. 3 is a front elevation view of the apparatus of the invention bending and forming sheet material into a U-shaped channel member according to the method of the invention.

As the anvil 122 continues its downward movement it moves the opposite left and right hand ends of the sheet metal 34 toward the pair of roller assemblies 42. The roller assemblies are positioned at their closest relative positions by the extended piston rods 24 of the linear actuators 18. As the sheet metal 34 is lowered by the downward movement of the anvil 122, the opposite left and right hand ends of the sheet metal 34 come into contact with the pair of rollers 44 mounted on the roller assemblies 42. The continued downward movement of the anvil 122 causes the pair of rollers 44 to exert a force on the opposite left and right hand ends of the sheet metal 34 that causes the opposite ends of the sheet metal to bend and form around the left and right hand lobes 132, 134 of the anvil. The continued downward movement of the anvil 122 forces the sheet metal 34 between the pair of rollers 44, causing the rollers to engage in rolling contact over the opposite left and right hand ends of the sheet metal 34. What is meant by rolling contact of the rollers is that the rollers actually roll over the opposite ends of the sheet metal while bending and forming the sheet metal around the opposite sides of the anvil. The rolling contact of the rollers on the sheet metal ends eliminates friction and avoids any sliding contact between the rollers and sheet metal ends and no tool marks due to friction or sliding contact are left in the sheet metal as the ends are formed. The rolling engagement of the rollers 44 over the opposite left and right hand ends of the sheet metal 34 forces the opposite ends of the sheet metal up around the radiused corners of the lobes 132, 134 and up against the opposite left and right hand side surfaces 126, 128 of the anvil as shown in FIGS. 3 and 5.

The downward movement of the anvil 122 forcing the sheet metal 34 between the pair of rollers 44 exerts forces against the pair of rollers 44 that tend to separate the roller assemblies 42. These forces are resisted by the force of fluid pressure inside the cylinder housings 22 of the linear actuators 18 that extends the piston rods 24 from the actuators. The fluid pressure force transmitted from the interiors of the cylinder housings 22 through the piston heads (not shown), piston rods 24, and sleds 26 of the press is sufficient to cause the pair of rollers 44 to bend and form the opposite ends of the sheet metal 34 over the left and right side lobes 132, 134 and against the side surfaces 126, 128 of the anvil, but is not sufficient to prevent the anvil 122 from its continued downward movement moving the opposite ends of the sheet metal 34 downward past the rollers 44.

As the anvil 122 continues to move downward, the pair of rollers 44 continue to roll over the opposite ends of the sheet metal 34 bending and forming the sheet metal against the opposite sides 126, 128 of the anvil. Because the bends in the opposite sides of the sheet metal 34 are formed by the rolling engagement of the rollers 44 over the ends, the channel bends in the sheet metal are not marred and do not have tooling marks commonly formed by prior art sheet metal forming tools that slide in friction engagement over the sheet metal when forming bends in the sheet metal.

When the anvil 122 has reached its furthest downward movement as shown in FIG. 5, and the pair of rollers 44 have completed bending and forming the opposite ends of the sheet metal 34 over the opposite side surfaces of the anvil, the press is then operated to elevate the anvil 122 from its position shown in FIG. 5. The specific angular orientations between the side surfaces 126, 128 and the bottom surface 124 of the anvil 122 are such that, as the anvil is elevated and the rollers 44 roll downward over the channel bends now formed in the opposite ends of the sheet metal 34, the rollers 44 disengage from the channel bends and the resiliency of the sheet metal 34 causes the channel bends to spring back from their acute interior angle configurations shown in FIG. 5 to right angle configurations. As the channel bends formed in the opposite ends of the sheet metal 34 spring back to the right angle configurations, the channel member formed from the sheet metal 34 will separate from the anvil 122 as the anvil is continued to be raised above the top surface of the support block 64. The newly formed channel member is then removed from the apparatus and the channel forming procedure is ready to be repeated.

While the present invention has been described by reference to a specific embodiment and a specific method, it should be understood that modifications and variations of the invention may be constructed or practiced without departing from the scope of the invention defined in the following claims.

What is claimed is:

1. A method of bending and forming sheet material in a forming press of a type comprising a base supporting a reciprocable support block, a reciprocable centering frame having a pair of centering cams thereon, and a pair of linearly movable centering blocks, the method comprising:

providing a movable anvil on the centering frame for movement with the centering frame and linear reciprocating movement relative to the centering frame;

providing a pair of spaced movable rollers on the base for linear movement toward and away from each other, reach roller having a center axis and each roller being rotatable about its center axis relative to the base;

positioning a sheet of material on the support block between the pair of centering blocks;

moving the centering frame toward the base causing the pair of centering cams to engage the centering blocks and move the centering blocks linearly toward the sheet material and engage and exert centering forces on opposite sides of the sheet material and center the sheet material on the support block;

continuing to move the centering frame toward the base causing the anvil to engage the sheet material and secure the sheet material between the anvil and the support block;

moving the centering frame away from the base and the anvil, causing the pair of centering cams to disengage from the centering blocks while maintaining the sheet material secured between the anvil and the support block;

moving the anvil, the support block and the sheet material secured therebetween toward the base and the spaced pair of rollers on the base until the spaced pair of rollers engage opposite ends of the sheet material on opposite sides of the support block and the anvil;

continuing to move the anvil, the support block and the sheet material secured therebetween toward the base causing the spaced pair of rollers to exert forces on the opposite ends of the sheet material that cause the opposite ends of the sheet material to bend and form around opposite side surfaces of the anvil;

moving the anvil, the support block and the sheet material secured therebetween away from the base causing the spaced pair of centering rollers to disengage from the opposite ends of the sheet material; and, continuing to move the anvil away from the base causing the anvil to disengage from the sheet material.

2. The method of claim 1 further comprising:

causing the pair of centering cams to engage the centering blocks and move the centering blocks toward the sheet material and center the sheet material on the support block prior to the anvil engaging the sheet material and securing the sheet material between the anvil and the support block.

3. The method of claim 1, further comprising:

moving the centering frame away from the base causing the centering cams to disengage from the centering blocks and relieve the centering forces exerted on the sheet material by the centering blocks following the anvil engaging the sheet material and securing the sheet material between the anvil and the support block.

4. The method of claim 1, further comprising:

causing the pair of rollers to simultaneously engage in rolling contact with the opposite ends of the sheet material and roll over the opposite ends while bending and forming the opposite ends against the opposite side surfaces of the anvil.

5. The method of claim 1, further comprising:

bending and forming the opposite ends of the sheet material at substantially equal acute interior angles against the opposite side surfaces of the anvil by the pair of rollers rolling against the opposite ends of the sheet material as the anvil, the support block and the sheet material secured therebetween move relative to the pair of rollers, thereby causing the opposite ends of the sheet material to remain bent at substantially right angles and forming the sheet material into a U-shaped channel.

6. In combination with a forming press of a type comprising a base supporting a reciprocable support block and a pair of linearly movable centering blocks, and a reciprocable ram assembly supporting a centering frame movable relative to the ram assembly, the centering frame having a pair of centering cams thereon, an improvement comprising:

an anvil mounted on the ram assembly for movement therewith, the anvil having a first surface for engaging and holding sheet material inserted into the forming press, and the anvil having second and third surfaces disposed at angular orientations relative to the first surface;

a pair of rollers mounted on the base for movement relative thereto, each roller having a center axis and each roller being mounted on the base for rotation of the roller about its center axis; and, a pair of sleds mounted on the base for linear movement of the sleds relative to the base, each sled of the pair of sleds supporting a roller of the pair of rollers thereon for rotation of the roller about the roller center axis relative to the sled, and the linear movement of each sled relative to the base imparting linear movement of the center axis of the roller supported by the sled relative to the base enabling the pair of rollers to engage in rolling contact with opposite ends of the sheet material held by the anvil and roll over the opposite ends while bending and forming the opposite ends against the second and third anvil surfaces as the anvil and sheet material held by the anvil move relative to the pair of rollers; and, the pair of sleds supporting the pair of rollers are positioned on the base below a top surface of the support block, and the pair of centering blocks are positioned on top of the pair of sleds.

7. The forming press of claim 6, wherein:

the second and third surfaces of the anvil are positioned on opposite sides of the anvil and on opposite sides of the first anvil surface.

8. The forming press of claim 7, wherein:

the second and third anvil surfaces having substantially identical angular orientations relative to the first surface of the anvil and cause the opposite ends of the sheet material held by the anvil to be bent at substantially equal angles over the first, second and third surfaces of the anvil by the pair of rollers rolling against the opposite ends of the sheet material as the anvil and the sheet material held by the anvil move relative to the pair of rollers.

9. The forming press of claim 6, wherein:

the opposite ends of the sheet material held by the anvil are simultaneously bent and formed against the second and third anvil surfaces by the pair of rollers as the anvil and sheet material held by the anvil move relative to the pair of rollers.

10. The forming press of claim 6, wherein:

the angular orientations of the second and third anvil surfaces relative to the first anvil surface cause the opposite ends of the sheet material held by the anvil to be bent at acute interior angles against the first, second and third anvil surfaces by the pair of rollers rolling against the opposite ends of the sheet material as the anvil and the sheet material held by the anvil move relative to the pair of rollers, and cause the opposite ends of the sheet material to remain bent at right angles after the sheet material is removed from the forming press.

11. The forming press of claim 6, wherein:

the anvil is mounted on the ram assembly between the pair of centering cams and between the pair of centering blocks enabling the pair of centering cams to engage the pair of centering blocks, causing the pair of centering blocks to center the sheet material relative to the anvil prior to the anvil engaging the sheet material.

* * * * *